US005101215A

United States Patent [19]

Creaser, Jr.

[11] Patent Number: 5,101,215

[45] Date of Patent: Mar. 31, 1992

[54] TELESCOPING LIGHTWEIGHT ANTENNA TOWER ASSEMBLY AND THE LIKE

[75] Inventor: Charles W. Creaser, Jr., Hollis, N.H.

[73] Assignee: Chu Associates, Inc., Littleton, Mass.

[21] Appl. No.: 453,787

[22] Filed: Dec. 20, 1989

Related U.S. Application Data

[63] Continuation-in-part of Ser. No. 289,402, Dec. 21, 1988, abandoned, which is a continuation of Ser. No. 158,076, Feb. 12, 1988, abandoned, which is a continuation of Ser. No. 925,457, Oct. 31, 1986, abandoned, which is a continuation of Ser. No. 733,236, May 10, 1985, abandoned.

[51] Int. Cl.[5] ..... H01Q 1/10

[52] U.S. Cl. ..... 343/883; 343/901; 52/118

[58] Field of Search ..... 343/883, 880, 890, 901; 52/631, 121, 118

[56] References Cited

U.S. PATENT DOCUMENTS

| | | | |
|---|---|---|---|
| 2,339,327 | 1/1944 | Fox | 52/121 |
| 2,795,303 | 6/1957 | Muehlhause et al. | 52/121 |
| 2,942,700 | 6/1960 | Parmenter et al. | 52/121 |
| 3,196,991 | 7/1965 | Johnson et al. | 52/632 |
| 3,328,921 | 7/1967 | Keslin | 52/121 |
| 3,722,154 | 3/1973 | Sakamoto et al. | 52/121 |
| 4,151,534 | 4/1979 | Bond | 343/883 |
| 4,176,360 | 11/1979 | Leavy et al. | 343/883 |
| 4,254,423 | 3/1981 | Reinhard | 343/883 |
| 4,357,785 | 11/1982 | Eklund | 52/632 |
| 4,587,526 | 5/1986 | Ahl, Jr. | 343/883 |
| 4,785,309 | 11/1988 | Gremillion | 343/883 |
| 4,932,176 | 6/1990 | Roberts et al. | 343/883 |

FOREIGN PATENT DOCUMENTS

| | | | |
|---|---|---|---|
| 0930442 | 5/1982 | U.S.S.R. | 343/883 |

*Primary Examiner*—Michael C. Wimer
*Assistant Examiner*—Hoanganh Le
*Attorney, Agent, or Firm*—Rines and Rines

[57] ABSTRACT

A lightweight extended aluminum or similar telescopic equilateral triangular tubular mast or tower assembly with coaxially disposed inner triangular sections and cable elevating and lowering drive apparatus for controlling low-resistance telescopic movement with alternate outside-to-inside canted pulley wheels mounted near the top of each section passing the cable downwardly and inwardly of the section to a flat pulley wheel mounted near the bottom of the next inner section.

5 Claims, 8 Drawing Sheets

TELESCOPING LIGHTWEIGHT ANTENNA TOWER ASSEMBLY AND THE LIKE

FIELD OF THE INVENTION AND CROSS-REFERENCE TO RELATED APPLICATIONS

This application is a continuation-in-part of U.S. patent application Ser. No. 07/289,402 (now abandoned), filed Dec. 21, 1988, which is a continuation of U.S. patent application Ser. No. 07/158,076, filed Feb. 12, 1988 (now abandoned), continued from U.S. patent application Ser. No. 06/925,457, filed Oct. 31, 1986 (now abandoned), and in turn continued from parent U.S. patent application Ser. No. 06/733,236, filed May 10, 1985 (now also abandoned).

The present invention relates to antenna tower assemblies or masts and the like, being particularly directed to lightweight structures of the telescoping type, readily raised and lowered in a portable manner.

BACKGROUND OF THE INVENTION

Various types of telescoping antenna rods and mast structures have been suggested and/or used in various fields to take advantage of the portability of relatively short structures which may, on site, be extended into relatively long or high structures, including those of said parent application and those of prior art references cited during the prosecution thereof, including U.S. Pat. Nos. 3,328,921 (Keslin), 2,339,327 (Fox), 4,357,785 (Eklund), 2,945,303 (Muehlhause et al.) and USSR Patent SU930442, considered the most pertinent by the Patent Office in the prosecution of said parent and continuation applications. The problem of providing a very lightweight, but structurally strong, telescoping tower for an antenna or similar rig that may be erected and collapsed in a portable manner has not, however, been satisfactorily addressed in terms of each of weight, numbers of different types of parts (and consequent complexity and cost), simplicity of erection and lowering, and stability, particularly for tall structures, and guy wire requirements.

SUMMARY OF THE INVENTION

An object of the present invention is to provide a novel telescoping antenna tower assembly and the like that in large measure obviates the above-discussed problems and provides a lightweight, structurally sound tower or mast assembly embodying many common or identical lightweight parts and simple raising and lowering mechanism, enabling portability and ease of operation, and with rapid simultaneous tower or mast section erection and lowering, even by a single operator, in significant improvement over the structure of said parent application and said references.

Another object is to provide a novel aluminum or similar telescoping mast or tower structure of more general utility, also employing novel alternate canted (inside-outside) cable pulleys and totally inside flat pulleys in each of the successive telescoping mast sections for achieving said improvement.

Other and further objects are explained hereinafter and are more particularly delineated in the appended claims.

In summary, from one of its broader aspects, the invention of this continuation-in-part application embraces a light-weight telescoping antenna tower assembly having, in combination, a plurality of hollow equilateral triangular tubular sections bounding successively diminishing areas, one nested within the other(s) in parallel longitudinal coaxial relationship, a cable for raising and lowering the successive sections, pulley means mounted on the tubular sections comprising alternately disposed canted pulley wheels mounted externally of successive sections near the top thereof and carrying the cable from an external upward direction along the section downwardly inside thereof to flat pulley wheels mounted near the bottom of the next inner section, and winch means disposed near the bottom of the lowermost outer tubular section and connected with the cable longitudinally harnessed over the successive canted and flat pulley wheels of the said pulley means to permit raising and lowering of the tubular sections by the cable in order smoothly to erect and lower the tower. Best mode and preferred embodiments and details are later presented.

BRIEF DESCRIPTION OF THE DRAWINGS

The invention will now be described with reference to the accompanying drawings, FIGS. 1A and 1B of which, as presented in said parent and continuation applications, are side elevational views of an antenna tower constructed in accordance with the invention in collapsed or retracted position and elevated position, respectively.

DETAILED DESCRIPTION OF THE INVENTION

Figure 1A:
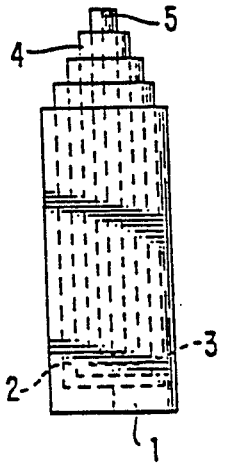
Figure 1B:
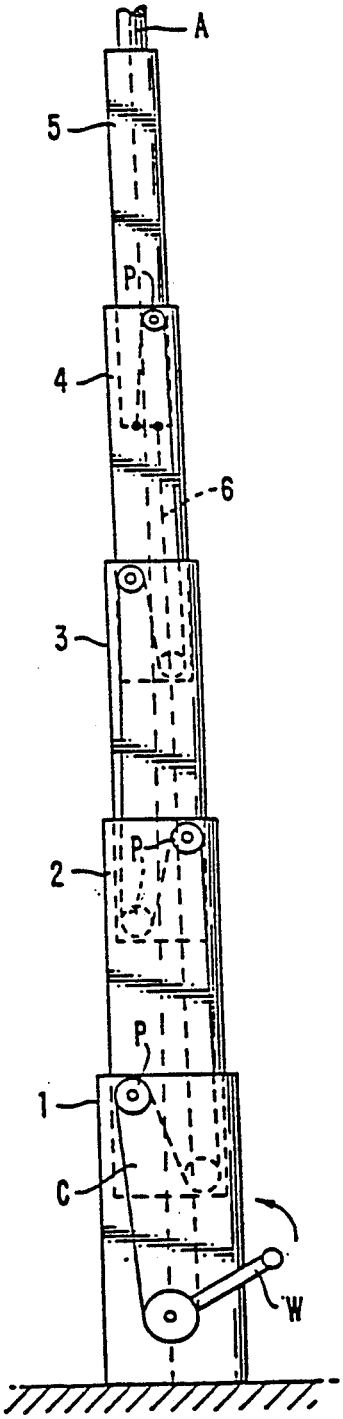
Figure 4:
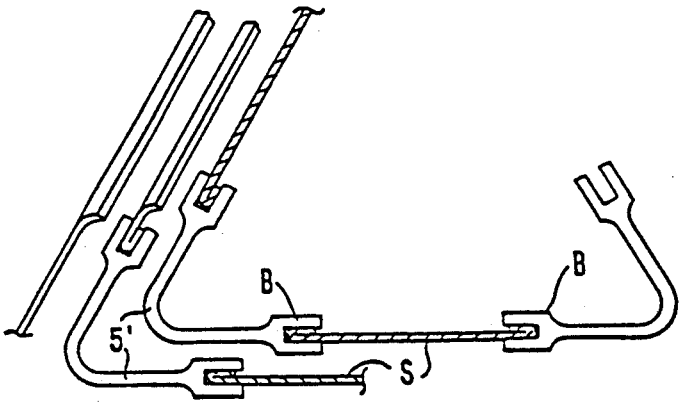
FIG. 4 is a fragmentary top elevation of the telescoped mast of FIGS. 2A and 2B, upon a larger scale.

Referring first to FIGS. 1A and 1B of the drawings, as presented in said parent and continuation applications, the mast or tower structure is shown constructed of a plurality of hollow equilateral triangular aluminum or similar thin-walled tubular sections 1, 2, 3, 4, 5, etc., enclosing successively diminishing areas (for structural rigidity), one nested within the other(s) in parallel longitudinal successive coaxial relationship. To achieve light weight and component or part similarity or identity, portability, and easy assembly and disassembly, the tubes are formed of aluminum sheet, perforated to minimize weight, having an equilateral triangular cross-section, the ends of the sheet meeting in one face where they are joined by riveting, crimping, or other means.

Figure 2A:
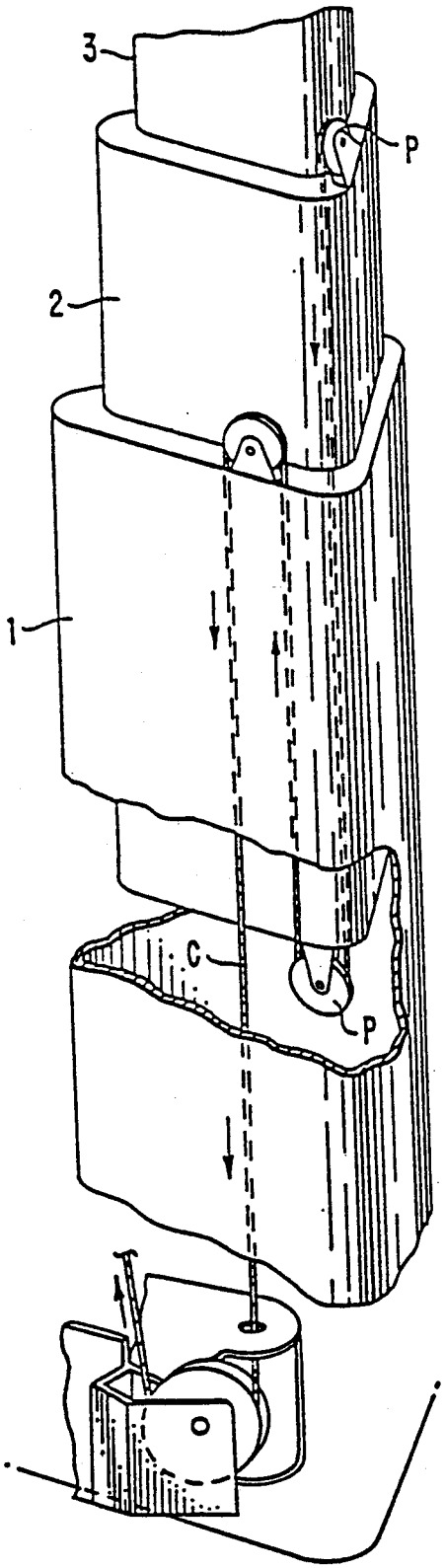
FIGS. 2A and 2B, also from said parent and continuation applications, are isometric views of successive sections of the tower, upon an enlarged scale, with preferred equilateral triangular tubular elements.
Figure 2B:
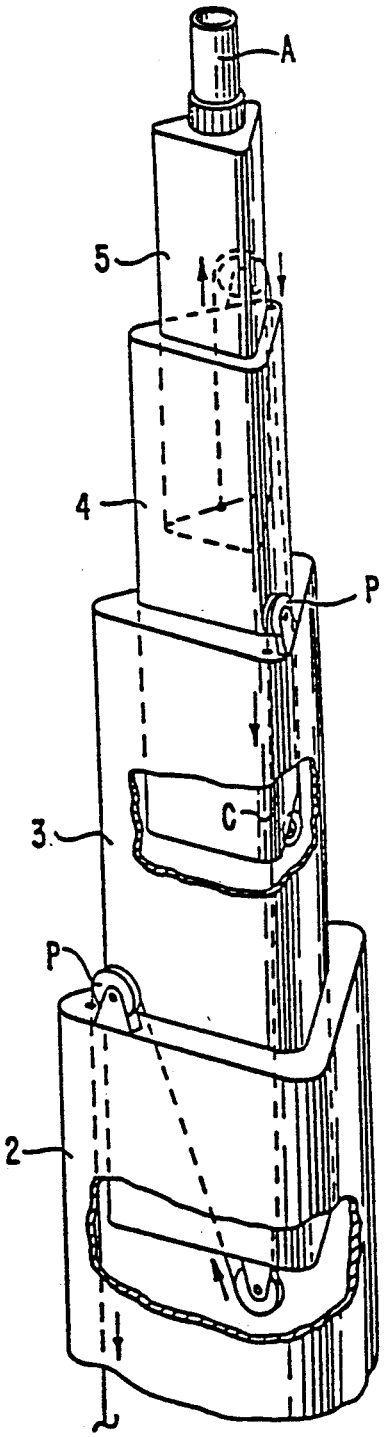
Figure 3:
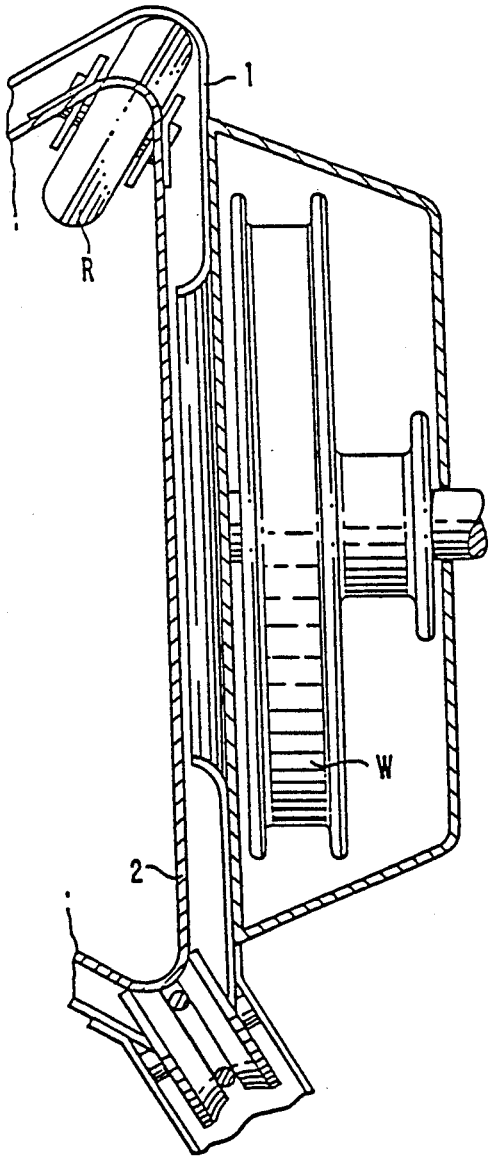
FIG. 3 is a transverse section near the bottom of the mast.

At or near the corners or vertices of successively adjacent tubes 1,2,3,4, etc., are pairs of externally mounted upper and lower pulley wheels P, more particularly shown in FIGS. 2A and 2B, receiving a cable harness C from a winch W (FIGS. 1B and 3) preferably disposed at the bottom of the outer tube 1 for ready hand, foot-pedal or other operation. The cable harness is designed to enable the tubular sections to be elevated one within the other, along rollers R in the corners, FIGS. 3 and 5, for erection of the tower, and also for positive cable control in lowering the same.

A suitable cable harness arrangement is shown schematically in FIG. 1B, and portions in FIGS. 2A and 2B.

With the mast assembly fully retracted as shown in FIG. 1A, and with winch W, FIG. 1B, hand cranked by the operator, a tension is developed within the cable of the harness arrangement which tension, due to the low frictional resistance of the sheaves, is the same throughout the system. This cable tension is transmitted first from the winch drum affixed to the side of outermost section 1 upward to and around the sheave affixed near the upper edge of this outermost section. It then continues downward to and around the sheave affixed near the lower end of the next inner section 2, then upward to and around a sheave affixed near the upper end of section 2. This connective means is continued through the successively inwardly located mast sections until the cable is finally terminated by means of a fixed connection to the lower end of the inntermost (top) mast section.

As the tension in the cable is increased, all mast sections remain stationary until sufficient tension is developed to raise the lightest, innermost mast section 5 in FIG. 1B. This section extends upward, out of the next innermost section 4, until it reaches the limit of its travel and becomes locked in section 4. As the cable tension is increased and becomes sufficient to raise the combined weights of sections 5 and 4, this sequence is repeated, with section 4 extending upward, out of section 3; and so on.

Figure 5:
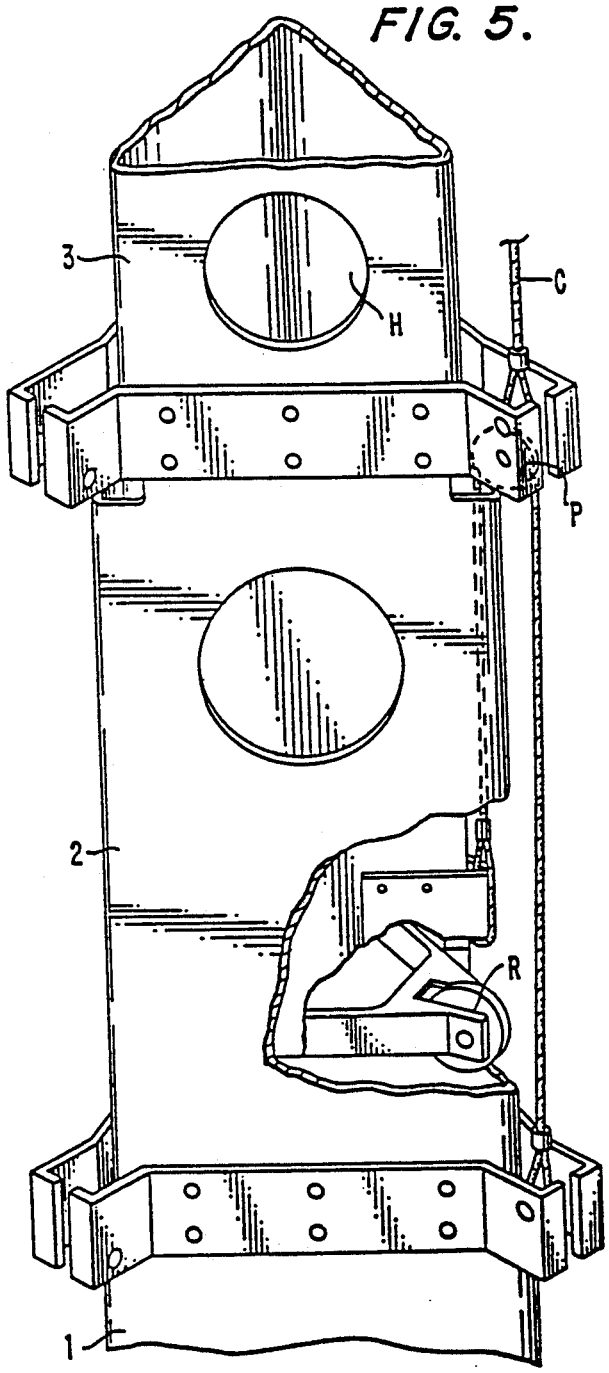
FIG. 5 is an isometric view, partly broken away, illustrating an alternate cable pulley mounting arrangement, with each of FIGS. 3–5 presented in said parent and continuation applications.

An alternate cable harness arrangement for hoisting is shown in FIG. 5. In this arrangement, a cable is affixed to the upper end of one mast section 1, in FIG. 5, and extends upward to and over a sheave near the upper end of the next inner mast section 2, and then downward, where it is affixed to the lower end of the next inward mast section 3. When the outer mast section 1 is fixed and the middle mast section 2 is raised, the upward motion of the inner section will cause the simultaneous raising of the innermost mast section 3. A hoist cable from the winch W attached to the side of lowermost mast section 1 extends upward to and over a sheave affixed to the upper end of the lowermost section. This cable extends downward to the lower end of mast section 2. When the hoist cable is retracted by the winch, the middle section 2 is raised relative to mast section 1, which causes mast section 3 to raise relative to mast section 2 as just described. This cable arrangement between mast sections is repeated, making all mast sections thus serially connected. The net result is that all mast sections extend simultaneously upon activation of the winch instead of extending singularly.

Returning now to FIGS. 1A and 1B, winding in the winch W will thus cause successive elevation of the tubular sections 2, 3, 4, etc., with the uppermost section (shown as 5) internally carrying the antenna A, which is raised above the mast section 5. The sections are held in elevated position by the taut cable and are lowered by the cable, as well, to prevent slippage.

When the rotation of the winch is reversed, the lower mast section 2, FIG. 1B, will retract into section 1 under the influence of gravity, and when fully seated, mast section 3 will retract into section 2, etc., until all sections are nested as shown in FIG. 1A. However, when the winds are sufficiently strong, friction between the mast sections can prevent the smooth and orderly retraction just described. To avert the undesirable consequences resulting from such a situation, a retraction cable 6, FIG. 1B, is provided. This consists of a cable connected from the lower end of the uppermost section 5, extending directly downward to a sheave in the base of lowermost section 1, and thence to a drum on the winch W.

A satisfactory telescoping mast or tower of this type has been constructed with the following section dimensions:

| | |
|---|---|
| Length, Retracted | 70 In. |
| Length, Fully Extended (Not Including Antenna) | 23 ft. 6 In. |
| Width, Transgular, each side dimension | 7.8 In. |
| Total Weight, Operating | 40 Lbs. |
| Total Weight, Transport | 46 Lbs. |
| Max. Cable Tension, To Extend | 44 Lbs. |
| Max. Guy Tension, 90 M.F.R. Wind, | |
| Upper Guy | 300 Lbs. |
| Lower Guy | 120 Lbs. |

For lightweight construction, the sheet walls of the triangular tubular members may be apertured as by punched holes H, the inner punching of which adds structural reinforcement, or by other perforations or lattice structures.

If desired, the inner tubular sections may initially be raised together before telescopically raising the successive inner tubes to successively higher elevation.

The structures of FIGS. 1A–5, however, while improving upon prior proposals, have been found to be subject to several disadvantages including awkwardness in the cable pulley elevating and depressing operations wherein, as before described, all mast sections remain stationary until sufficient tension is developed to raise the innermost section, each section is raised until it is locked in fully extended position, slippage prevention is difficult, and smooth and orderly retraction is difficult and at best requires special retraction cables (as at 6, FIG. 1B)—the mast being hard to operate in practice by a single operator and lacking low-tension, smooth and continuous elevation and lowering facility. It is to the solution of these and related problems, accordingly, that the improvements of the present invention of FIGS. 6–11 are directed.

As will be observed from the embodiment of FIGS. 6A–C, 7 and 8, instead of employing all straight, flat or vertically planar pulleys in the cable system, as in the earlier versions of FIGS. 1A–5 and in other of the previously cited references, it has been discovered that remarkably facile, relatively low operating force, and positive and smooth simultaneous mast section elevation and retraction can be attained by the use of outside-inside canted cable pulley wheels, such as $P_1$, $P_3$, $P_5$, etc., passing the cable C from outside the mast sections downwardly inside the same and around internally disposed alternate flat pulley wheels $P_2$, $P_4$, $P_6$, etc., as will later be more fully explained. Through this construction and other significant changes, including preferably elimination of the corner roller wheels R, coupled with a novel arrangement of double winch spools, a lower outside-inside down cable tube and an upper section spring cable preload mechanism SP cooperating with a top set of pulley wheels $P_8$, $P_8'$, $P_7$ amplifying spring extension distance, the novel degree of positive control by a single operator becomes readily attainable, as do the other features of significant improvement before discussed.

Referring to FIGS. 6A–C, 7 and 8, the winch handle W is shown operating with two spools, a take-up or retract spool $S_1$, shown on the left, and an inner spool $S_2$ which is the one that is cranked up, the so-called up-spool or hoist spool. The cable C comes off the inside or up-spool $S_2$ at $C_1$ and is passed on the outside around a pulley $P_1$ near the top of the first mast section 1. The pulley wheel $P_1$ is canted or inclined or tilted from the outside to the inside at the top of the mast section 1 as more particularly shown in FIG. 7, so as to pass the cable at $C_1$ extending upwardly from outside the mast section 1, FIGS. 7, 7 A–B and 8, downwardly inside at $C_2$ to the non-canted or flat pulley $P_2$ mounted near the bottom of the second mast section 2 inside section 1.

The cable from non-canted pulley $P_2$ goes upward at $C_3$ again outside the mast at the upper region of section 2, to and over the next similarly canted pulley wheel $P_3$ mounted near the top of section 2 and passing the cable inside at $C_4$ over flat pulley $P_4$ mounted near the bottom of the next internal mast section $P_3$ inside the upper portion of section 2. The up-cable continues at $C_5$ upwardly and outside section 3 to external canted pulley wheel $P_5$ mounted near the top of section 3 and which passes the cable inside and downwardly at $C_6$ to flat pulley $P_6$ carried near the bottom of the next inner mast section 4. From pulley $P_6$, the up-cable proceeds upwardly and outside the next inner mast section 4 at $C_7$ to its upper canted pulley $P_7$ and then inside and downwardly of the upper portion of section 4 and then around and inside upwardly at the bottom of the uppermost antenna-carrying mast section 5, as later described.

Figure 9:
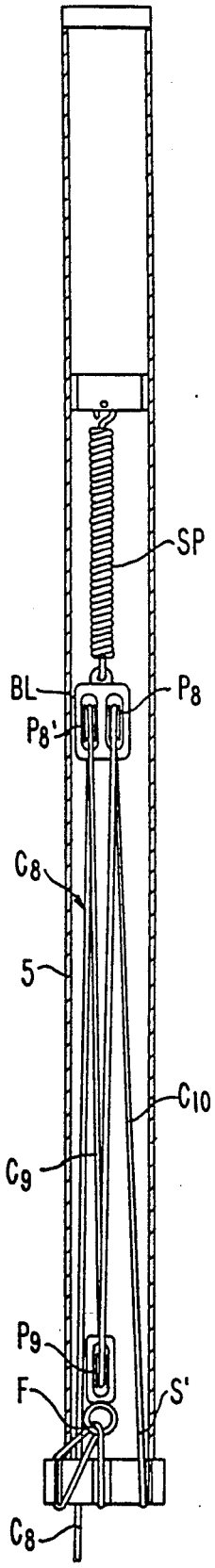
FIG. 9 is a similar section at the region of the topmost section.

The down cable $C_8$ passes over flat pulley $P_8'$ carried in a pulley block BL that is spring-loaded by cable preload spring SP in the upper section of the topmost mast section 5, downwardly at $C_9$ over flat pulley $P_9$, anchored to the bottom of the uppermost mast section 5 at F, FIG. 9, and passing back up over pulley $P_8$ alongside $P_8$ in the block BL and thence at C10 to be secured to the bottom of mast section 5 at S'. Hoist cable section $C_7$ terminates at the bottom of the topmost section 5, also, where it is rigidly affixed at S'', FIG. 8. The down or retract cable $C_8$ thus extends upward through the inside of the mast, FIG. 9, to pulley block BL, passing around the three pulleys $P_8$, $P_8'$ and $P_9$ and finally terminating at the bottom of the uppermost section where it is rigidly affixed at S' as previously stated. The purpose of this arrangement is to amplify the spring extension; i.e., one inch of extension of the spring allows four inches of extension in the retract cable.

Figure 9A:
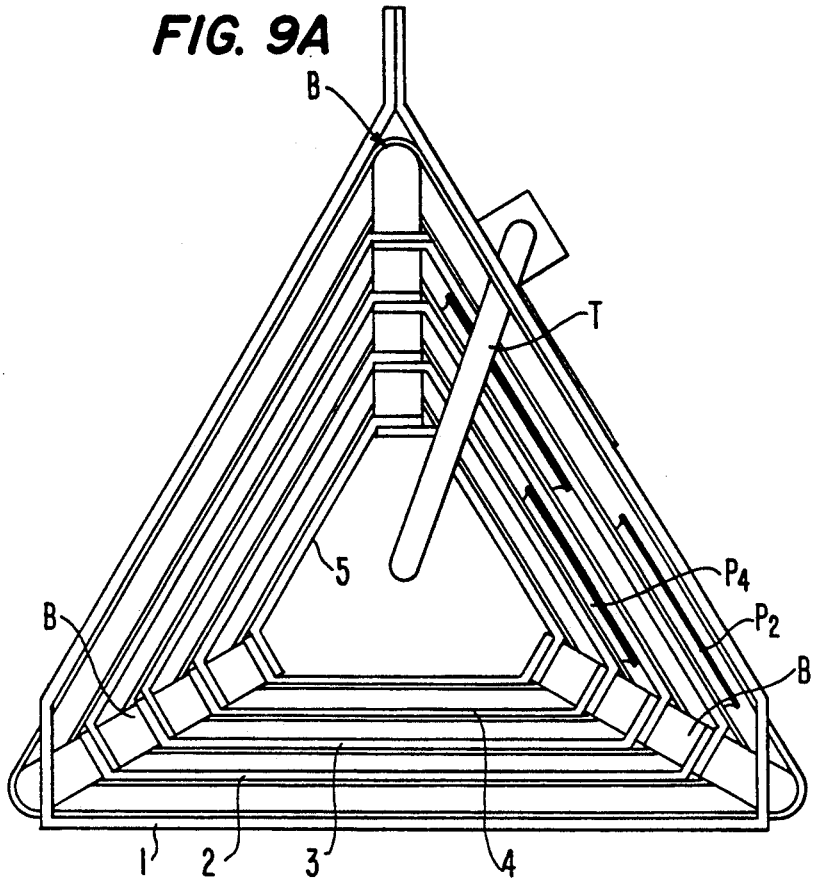
FIGS. 9A and 9B are respectively end views looking from the bottom of the mast upwardly and downwardly from the top, again on an enlarged scale.
Figure 9B:
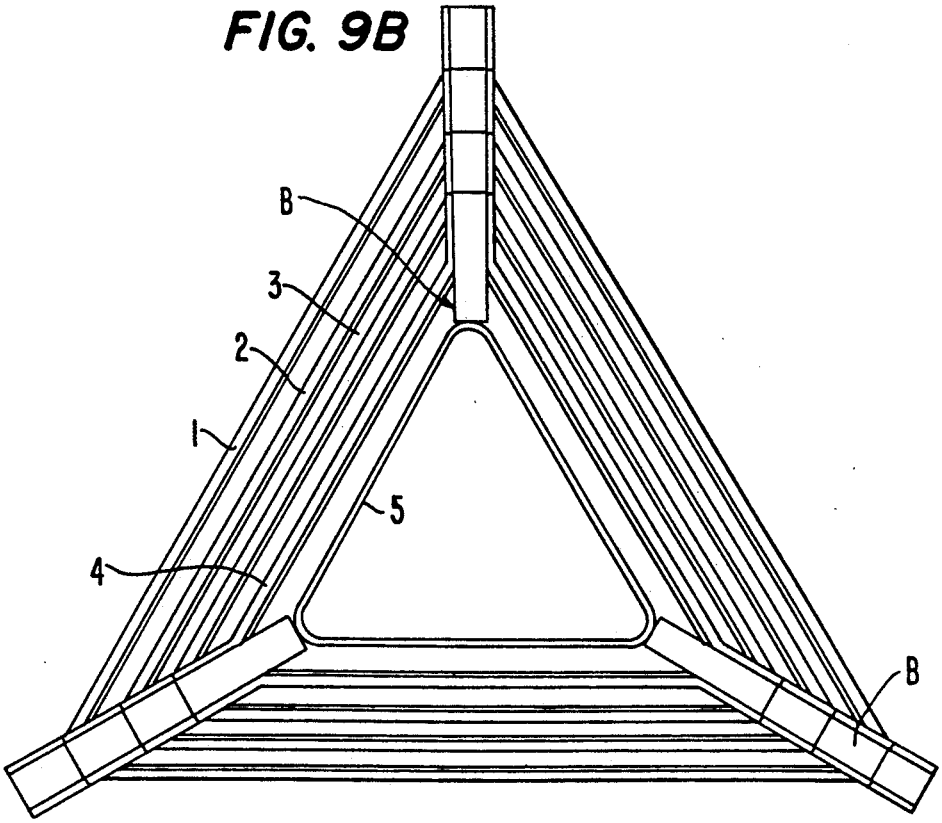

The preload spring SP keeps the cable always in tension as the height of the mast sections continually changes with varying amount of cable. The spring takes up the difference in the length of the cable as a result of the changing diameters of the spools $S_1$ and $S_2$, FIG. 6B and 11. As the amount of cable wound on $S_1$ and $S_2$ varies from one to the other, the effective diameters change and the preloaded spring SP at this point allows that change without permitting slack in the cable. The use of alternate canted and uncanted pulleys, as described, enables getting the cable from the outside to the inside without interference between the cable with the pulleys and with the wall of the section going up, and without risking shearing the cable line. By running inside-outside, moreover, all the sections raise and lower almost together. Plastic support or rail blocks B in the corners of the sections, FIGS. 6C, 9A and 9B, as distinguished from rollers (FIG. 3), have been found to effect low-resistance simultaneous elevation and retraction smoothly and with minimal force. Three blocks are shown used in each section in the corners, and they stabilize each section and provide low resistance to cranking.

Figure 10:
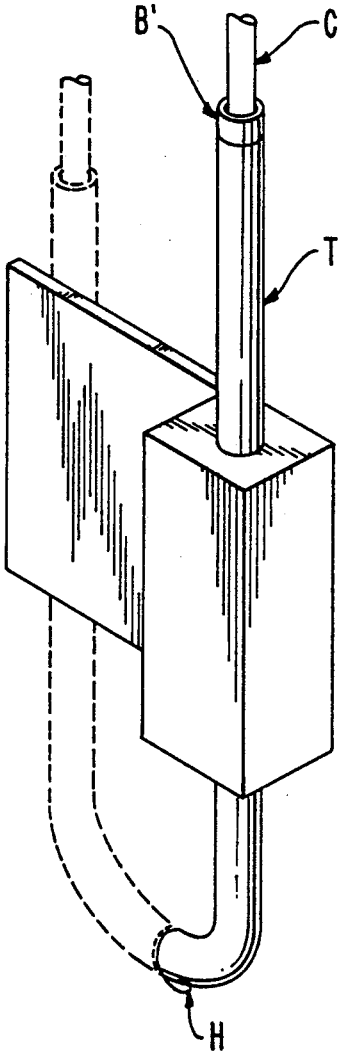
FIG. 10 is a fragmentary isometric of the outside-inside cable tube region at the bottom of the mast.
Figure 11:
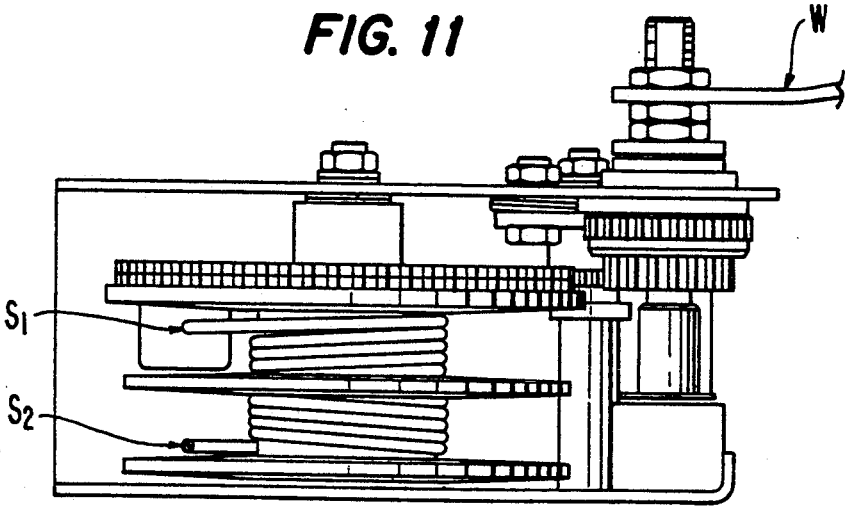
FIG. 11 is an enlarged top elevation of the cable storage reels and winch handle near the bottom of the mast.

In accordance with a further feature of the present invention, a tube T, as of steel, is provided near the base, FIGS. 6A–C, 8, 9A and more particularly in FIG. 10, as a means of passing the cable from the inside to the outside at this point through all the sections, it being necessary to enable cable passage from the inside to the outside of all sections without interference therewith. At the top of the tube T, an apertured bead B' is provided, as of Teflon plastic or the like, to wipe the cable free of collected dirt and prevent such from collecting during the winding of the winch on the spools. A drain hole H is provided at the bottom.

Figure 6C:
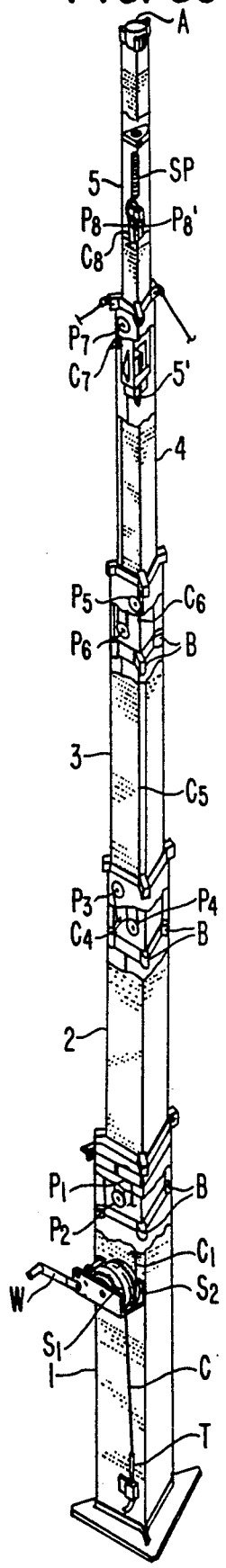
FIGS. 6B and 6C are similar views of successive positions of mast elevation.
Figure 6B:
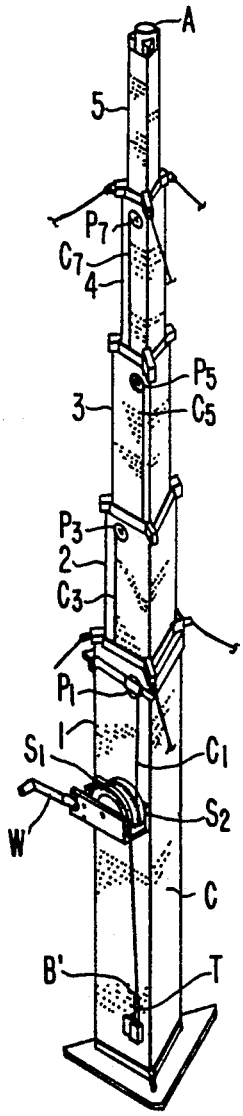
Figure 6A:
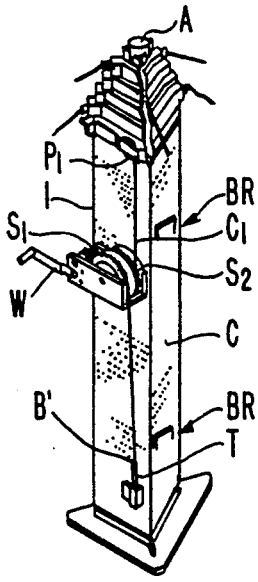
FIG. 6A is an isometric view of a collapsed telescopic mast embodying the improvements of the present application.
Figure 7A:
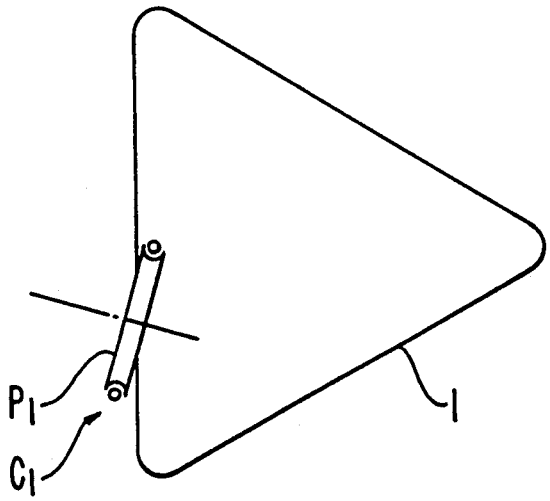
FIGS. 7A and 7B show details.
Figure 7B:
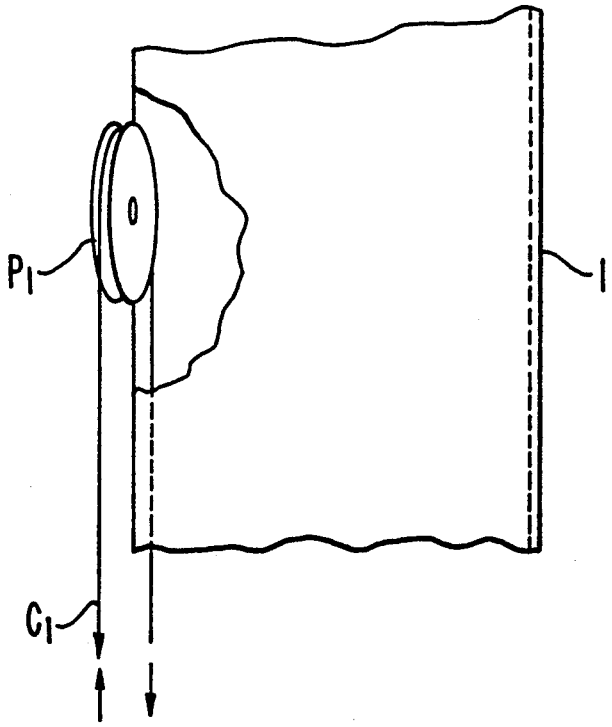
Figure 7:
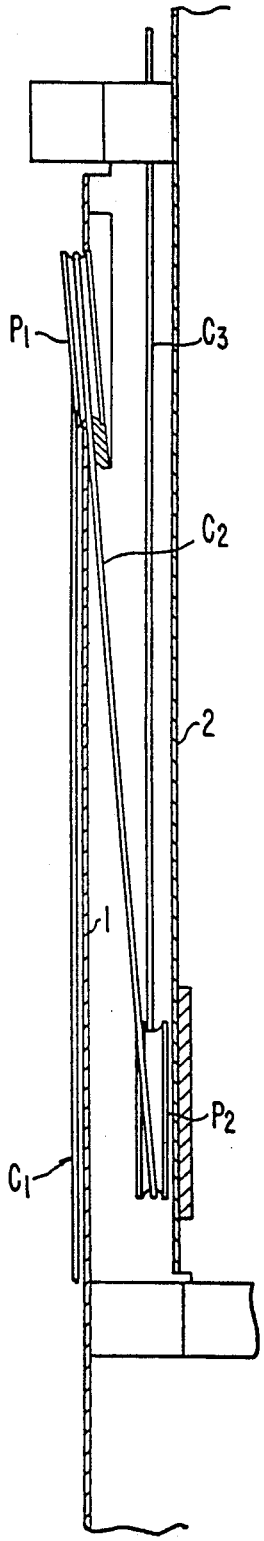
FIG. 7 is a longitudinal section of the first canted cable pulley P1 and the first flat or straight pulley P2 of the lowermost mast sections.
Figure 8:
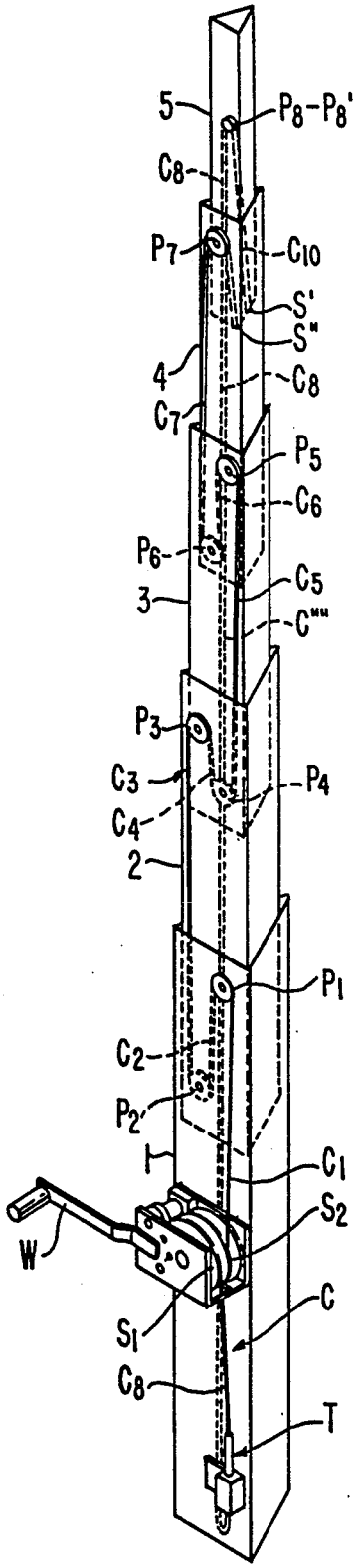
FIG. 8 is a view similar to FIGS. 6A and B but on a larger scale and with some external parts removed.

With the invention enabling such easy one-operator handling, the mast may readily be ported to different locations for erection and removal; and side brackets BR, FIG. 6A, may be provided to permit attachment to walls for ready erection.

Further modifications will also occur to those skilled in this art, such being considered to fall within the spirit and scope of the invention as defined in the appended claims.

What is claimed is:

1. A light-weight telescoping antenna tower assembly having, in combination, a plurality of hollow equilateral triangular tubular sections bounding successively diminishing areas, one nested within the other in parallel longitudinal coaxial relationship, a cable for raising and lowering the successive sections, pulley means mounted on the tubular sections comprising alternately disposed canted pulley wheels mounted externally of successive sections near the top thereof and carrying the cable from an external upward direction along the section downwardly inside thereof to flat pulley wheels mounted near the bottom of the next inner section, and winch means disposed near the bottom of the lowermost outer tubular section and connected with the cable longitudinally harnessed over the successive canted and flat pulley wheels of the said pulley means to permit raising and lowering of the tubular sections by the cable in order smoothly to erect and lower the tower, and in which the winch means comprises an outer cable take-up spool and an inner winch up-spool the effective diameters of which vary as the cable is winched up and down, with the top innermost section of the assembly provided with further pulley means connected with a preloaded spring secured to that section to avoid any slack in the cable during its elevation and lowering, and further in which tubular means is disposed near the bottom of the lowermost tube section to pass the cable from its downward extension within the sections through the lowermost section externally upwardly to the take-up spool of the winch means.

2. An antenna tower assembly as claimed in claim 1 and in which the tubular means is provided at its upper end with a plastic bead to wipe off dirt before reaching said take-up spool and with drain means at its lower end.

3. A light-weight telescoping antenna tower assembly having, in combination, a plurality of hollow equilateral triangular tubular sections bounding successively diminishing areas, one nested within the other in parallel longitudinal coaxial relationship, a cable for raising and lowering the successive sections, pulley means mounted on the tubular sections comprising alternately disposed canted pulley wheels mounted externally of successive sections near the top thereof and carrying the cable from an external upward direction along the section downwardly inside thereof to flat pulley wheels mounted near the bottom of the next inner section, and winch means disposed near the bottom of the lowermost outer tubular section and connected with the cable longitudinally harnessed over the successive canted and flat pulley wheels of the said pulley means to permit raising and lowering of the tubular sections by the cable in order smoothly to erect and lower the tower, and in which the winch means comprises an outer cable take-up spool and an inner winch up-spool the effective diameters of which vary as the cable is winched up and down, with the top innermost section of the assembly provided with further pulley means connected with a preloaded spring secured to that section to avoid any slack in the cable during its elevation and lowering, said further pulley means comprising a pair of parallel pulleys disposed in a block held by the spring and passing the cable between them over a lower pulley secured to the bottom of the uppermost section, with the end of the cable secured to the bottom of said uppermost section.

4. An antenna tower assembly as claimed in claim 3 and in which the tubular sections are provided with plastic block means disposed in and between the adjacent corners of the successive tubular sections to permit low-resistance sliding longitudinal axial relative movement.

5. An antenna tower assembly as claimed in claim 3 and in which the cable harness is arranged to permit simultaneous elevation of the sections and the converse on lowering.

* * * * *